United States Patent [19]

Fotland

[11] 4,282,297

[45] Aug. 4, 1981

[54] CHARGE TRANSFER IMAGING

[75] Inventor: Richard A. Fotland, Holliston, Mass.

[73] Assignee: Dennison Manufacturing Company, Framingham, Mass.

[21] Appl. No.: 139,959

[22] Filed: Apr. 14, 1980

Related U.S. Application Data

[60] Division of Ser. No. 969,516, Dec. 14, 1978, which is a continuation-in-part of Ser. No. 816,012, Jul. 15, 1977, abandoned, which is a continuation-in-part of Ser. No. 807,451, Jun. 17, 1977, abandoned.

[51] Int. Cl.[3] ..... G03G 13/18

[52] U.S. Cl. ..... 430/48; 430/60; 430/63

[58] Field of Search ..... 252/501.1; 430/71, 63, 430/60, 48

[56] References Cited

U.S. PATENT DOCUMENTS

| | | | |
|---|---|---|---|
| 3,041,166 | 6/1962 | Bardeen | 252/501.1 |
| 4,052,209 | 10/1977 | Huffman et al. | 430/71 |
| 4,133,684 | 1/1979 | Tarumi et al. | 430/63 |
| 4,139,380 | 2/1979 | Matsuo et al. | 430/60 |

FOREIGN PATENT DOCUMENTS

| | | | |
|---|---|---|---|
| 1035892 | 7/1966 | United Kingdom | 430/60 |

*Primary Examiner*—Richard L. Schilling
*Assistant Examiner*—John L. Goodrow
*Attorney, Agent, or Firm*—Arthur B. Moore; George E. Kersey

[57] ABSTRACT

Charge transfer imaging method and apparatus using a photoreceptor assembly. The assembly, which is formed by the interposition of a semiconducting substrate between a photoreceptor and a conducting base member, is used to transfer an image to a dielectric member with reduced image degradation.

5 Claims, 4 Drawing Figures

FIG. 3
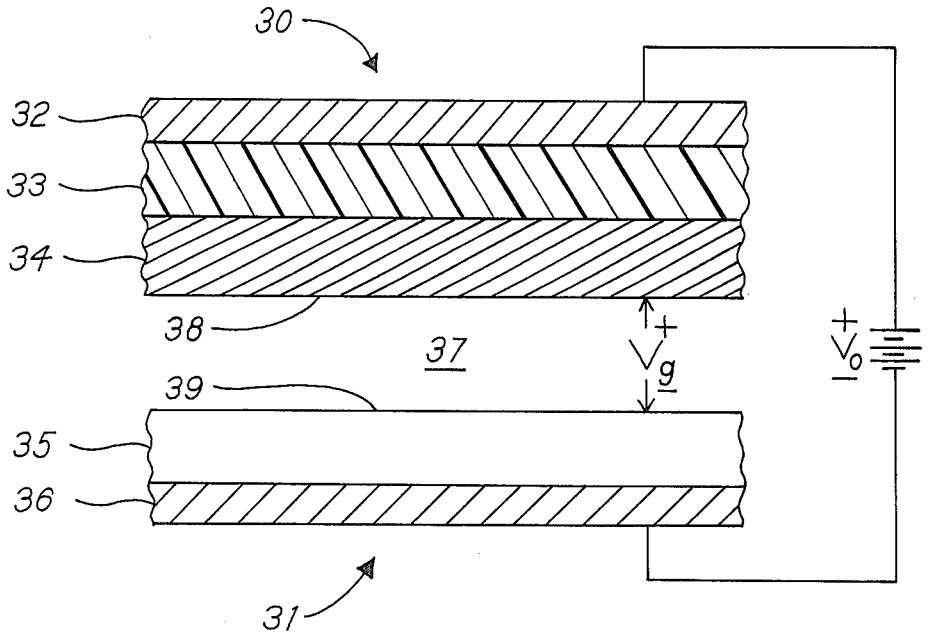
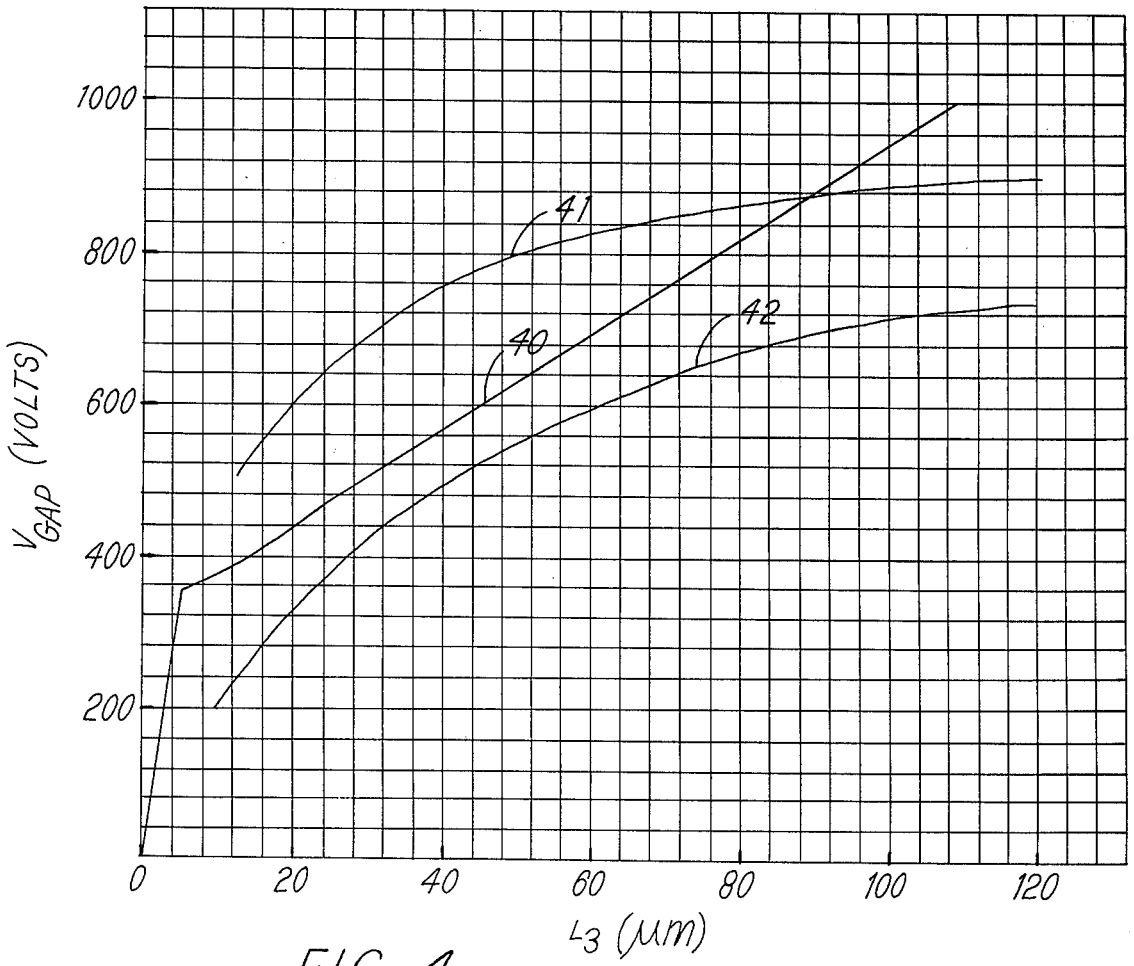
FIG. 4

CHARGE TRANSFER IMAGING

This is a division, of Ser. No. 969,516, filed Dec. 14, 1978, which is a continuation-in-part of Ser. No. 816,012, filed July 15, 1977 now abandoned, which is a continuation-in-part of Ser. No. 807,451, filed June 17, 1977 now abandoned.

BACKGROUND OF THE INVENTION

The present invention relates to charge transfer imaging, and more particularly to charge transfer imaging employing a modified photoreceptor assembly to provide reduced image breakup during the transfer process.

In charge transfer electrophotography, a photosensitive material is provided with the electrostatic counterpart of an image that is to be reproduced. The electrostatic image is then transferred to a member possessing a dielectric surface.

Unfortunately, in the ordinary usage of the foregoing charge transfer technique, a disruptive image breakup has been often encountered when the charge photosensitive surface has been brought to the vicinity of the carrier surface. This effect is described in detail in *Xerography and Related Process,* edited by John H. Desrauer and Harold E. Clark, the Focal Press, London and New York 1965 at Page 434.

Accordingly, it is an object of the invention to reduce the extent of image degradation that takes place when a surface with an electrostatic image is brought to the vicinity of a surface to which the electrostatic image is to be transferred.

Still another object of the invention is to modify a conventional photoreceptor assembly to achieve reduced image degradation in electrophotography. A related object is to achieve a modified photoreceptor assembly for use in reducing the extent of image degradation when a charge surface of the photoreceptor assembly is brought to the vicinity of a receptor dielectric surface.

SUMMARY OF THE INVENTION

In accomplishing the foregoing and related objects the invention provides a photoreceptor assembly which is advantageously employed in a charge transfer imaging system to transfer an image from the photoreceptor assembly to a dielectric member with reduced degradation in the transferred image.

In accordance with one aspect of the invention the photoreceptor assembly for providing image transfer with reduced degradation is formed by a semiconductor interposed between a photoconductor and a conducting substrate.

According to another aspect of the invention the semi-conductor interposed between the photoconductor and the conducting substrate of the photoreceptor assembly has a resistivity between $10^3$ and $10^{12}$ ohm centimeters.

In accordance with still another aspect of the invention the semiconductor is selected from the class comprising semiconductive plastics and semiconductive elastomers, for example those provided by conductors dispersed in either a plastic or elastomer matrix. In particular the semiconductor can be formed by dispersing carbon black in elastomer or in an epoxy resin.

In accordance with still another aspect of the invention the photoconductor is selected from the class consisting of cadmium sulfide dispersed in a binder comprising an organic polymer matrix, including epoxys, silicones and thermoplastics, or selenium and selenium alloys, including amorphous selenium, zinc oxide binder layers, and polyvinylcarboxole-trinitrofluorenone complexes.

According to a further aspect of the invention both the photoconductor and semiconductor are in the form of layers on a drum, a flexible belt, a plate or any other suitable substrate member which is advantageously a conductor. The thickness of the semiconductive layer desirably is greater than 1 mil. The photoconductor and semiconductor can be formed from the same plastic or elastomeric matrix, for example, a thermoset resin and the desired semiconductive and photoconductive properties can be achieved by varying the concentration of, for example, cadmium sulfide in the matrix. A suitable concentration of cadmium sulfide to provide semiconductivity is 30% or more, while a concentration of less than 30%, illustratively about 18%, will provide photoconductivity.

DESCRIPTION OF THE DRAWINGS

Other aspects of the invention will become apparent after considering several illustrative embodiments taken in conjunction with the drawings in which

FIG. 3 is a schematic sectional view of a charge transfer member employing a photoreceptor assembly in accordance with the invention, together with a dielectric receptor member; and FIG. 4 is a set of plots of air gap width against gap voltage for the charge transfer assembly of FIG. 3.

DETAILED DESCRIPTION

Figure 1:
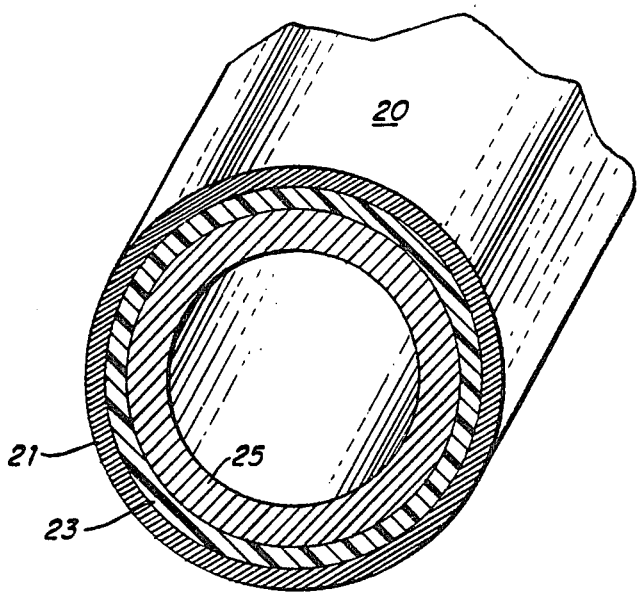
FIG. 1 is a perspective view of a schematic charge transfer member employing a photoreceptor assembly in accordance with the invention.

Turning to the drawings, a schematic representation of a charge transfer imaging assembly, in accordance with the invention, is outlined in FIG. 1.

In the particular embodiment of FIG. 1, the photoreceptor assembly 20 is a drum with a photoconductive layer 21 overlying a semiconductor layer 23 on a conducting substrate 25.

In the conventional transfer process, the presence of the electric field associated with the charges of the electrostatic image formed on the drum 20 results in image degradation in the transfer process. The effect of such image degradation is mitigated in accordance with the invention by the inclusion of the semiconductor 23 between the conducting substrate 25 and the photoconductor 21.

Figure 2:
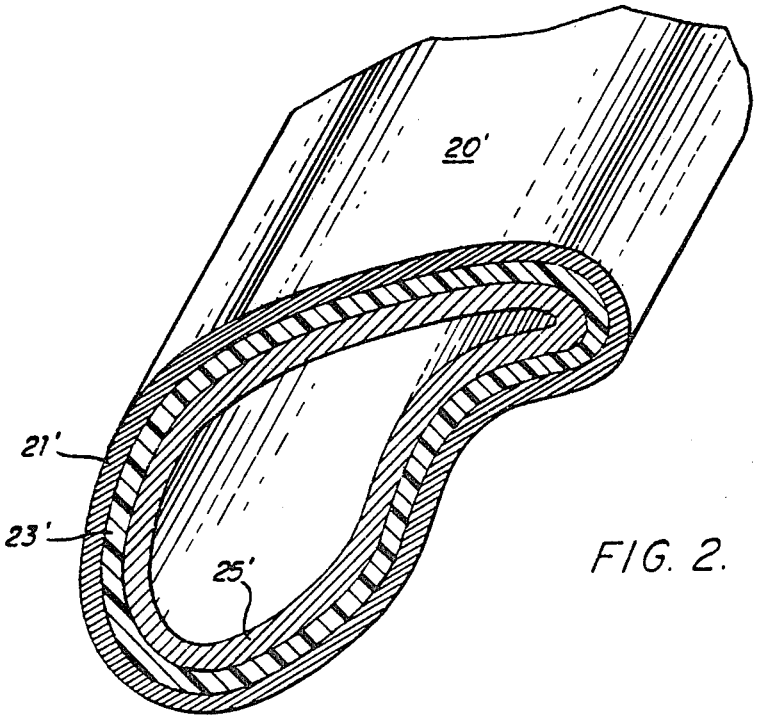
FIG. 2 is a perspective view of an alternative photoreceptor assembly.

Other forms of photoreceptor assembly in accordance with the invention can be provided, for example, by the flexible belt 20' of FIG. 2 in which a photoconductive layer 21' overlies a semiconductive layer 23' which is in turn positioned on a conductive substrate 25'. In order to achieve the desired conductive substrate 25' a conductive coating may be applied to a plastic film or the substrate may be a thin metallic foil, for example nickel.

The conducting substrate 25 of the drum 20 in FIG. 1 is illustratively of aluminum, but any combination of materials which provides the desired conductivity may also be employed.

It has been empirically discovered that the semiconducting layers 23 and 23' preferably have a thickness greater than 1 mil. The resistivity of the semiconductive layer must be such that charge will pass through the layer in a reasonable time. Accordingly, the resistivity is advantageously less than $10^{12}$ ohm centimeters.

On the other hand the resistivity must be sufficiently high to provide a time constant for smoothing the charge transfer and thus reduce the degradation of the transfer image as heretofore encountered. The lower level of resistivity for the semiconductive layers 23 and 23' depends on the thickness of the layers and the operating speed. It has been discovered generally that a resistivity of more than $10^3$ ohm centimeters is suitable.

The semiconductive layer may be realized in a variety of ways. It may be formed by a semiconductive plastic or a semiconductive elastomer. A suitable conducting agent is carbon black, while a suitable matrix for receiving the carbon black is an epoxy resin. Thus the semiconductor layer may be formed by dispersing carbon black in a resin matrix to achieve a resistivity within the range set forth above. Similarly a wide variety of rubbers can be used with carbon black to obtain the desired resistivity.

The photoconductor may be of the type generally employed in electrostatic imaging. Materials which have been found to function satisfactorily include polyvinylcarbazole complexed with trinitrofluorenone; cadmium sulfide dispersed in a variety of binders including epoxies, silicones and thermoplastics; selenium and selenium alloys, including amorphous selenium, and low fatigue zinc oxide.

In general, for binder layer photoconductors, the semiconducting layer may also be formed of the same material as the photoconductor, but with a higher photosensitive element concentration, thus a photoconductive layer of cadmium sulfide in epoxy with an 18% concentration behaves as an insulator in the dark, while the same layer with a 30% cadmium sulfide concentration behaves as a semiconductor in the dark.

With any of the foregoing photoconductive layers, disruptive image breakdown of the kind discussed in observed when the latent image receptor consists of a dielectric surface contiguous to a conducting surface. The presence of this semiconducting layer 23 or 23' between the photoconductor 21 or 21' and the substrate 25 or 25', however, significantly reduces degradation due to disruptive breakdown. Although the phenomenon by which the semiconducting layer eliminates the disruptive breakdown is not completely understood, it is believed that the time constant introduced by this semiconducting layer has the effect of smoothing or reducing the precipitous behaviour otherwise associated with disruptive breakdown.

In addition to possibly smoothing out the air gap breakdown, the presence of the semiconductor layer has the effect of reducing the gap width over which breakdown occurs.

The magnitude of this gap reduction may be analyzed by considering FIG. 3.

This Figure illustrates charge transfer from a photoreceptor assembly 30 to a dielectric receptor assembly 31 as the surface of a photoconductor layer 34 approaches the surface of a dielectric receptor layer 35. 32 and 36 are conductive support members while 33 is a resistive layer interposed between photoconductor layer 34 and conductive support 32. The boundary conditions are defined by the values set out in Table 1. In addition to these values, $V_g$ is the time variable voltage across air gap 37, and $V_O$ is a bias voltage applied between conductive supports 32 and 36 to aid charge transfer. $D_p$ is the surface charge density of the air gap surface 38 of photoconductive layer 34, while $D_d$ is the surface charge density of the air gap surface 39 of dielectric receptor layer 35. Prior to discharge, $D_p$ and $D_d$ are constant.

By a proper choice of various parameters for the charge transfer assemblies of FIG. 3, one can reduce the gap width $L_3$ at which air gap breakdown occurs. This is illustrated in the graph of FIG. 4, which plots air gap voltage against gap width. The curve 40 represents the breakdown voltage curve which is the maximum voltage which can be supported across the gap as a function of gap width. This curve is taken from R. N. Schaffert, *Electrophotography,* The Focal Press, London and New York, 1965, at 323.

Gap voltage $V_g$ as a function of gap width $L_3$ may be analyzed for a given set of boundary conditions of the charge transfer assemblies of FIG. 3 using Kirchoff's laws and the principle of conservation of charge. When the time rate of change in $L_3$ is small as compared with the electrical time constant of semiconducting layers 33, so that no significant voltage is supported across the semiconductive layer, analysis gives the voltage across the gap as:

$$V_g = \frac{L_3 / E_3}{L_2 / E_2 + L_3 / E_3 + L_4 / E_4}\left(V_0 + \frac{D_p L_2}{E_2} - \frac{D_d L_4}{E_4}\right)$$

which is shown as curve 41 in FIG. 4. This is the same curve which would arise if the semiconductive layer were not present (i.e. $L_1=0$). In this case, the breakdown first occurs at relatively large gap widths.

When the time rate of change in $L_3$ is rapid as compared with electrical time constant of semiconducting layer 33, a voltage is maintained across the semiconducting layer and the voltage across the gap is given by:

$$V_g = \frac{L_3 / E_3}{L_1 / E_1 + L_2 / E_2 + L_3 / E_3 + L_4 / E_4}\left(V_0 + \frac{D_p L_2}{E_2} - \frac{D_d L_4}{E_4}\right)$$

which is shown in FIG. 4 as curve 42. In the case of very rapid changes in gap length, the voltage may be reduced by such an amount that it never exceeds the breakdown voltage.

For intermediate time rates of change of the gap length, the voltage across the gap initially follows curve 42 and relaxes with time toward curve 41. This relaxation occurs because the voltage across the semiconducting layer causes a current flow through the layer which eventually transfers sufficient charge across the layer to reduce this voltage to zero. By this means, the point at which the gap voltage first exceeds the air gap breakdown voltage may be shifted to significantly smaller lengths.

The parameters required to achieve this reduction can be demonstrated by the following example. The curves 41 and 42 are based on a photoconductor layer 34 with a thickness of 25 μm and a dielectric constant of 4. In this example, dielectric layer 35 has a thickness of 42 μm with a dielectric constant of 6, and semiconductor layer 33 is 150 μm with a dielectric constant of 5. Both curves assume an initial photoconductor voltage ($D_pL_2/E_2$) of 900 volts with a bias voltage $V_O$ of 100 volts. With no semiconductive layer present, breakdown, determined by following curve 41, would begin at approximately 90 μm. The inclusion of a semiconductive layer 33 conforming to the parameters given could reduce the gap width at which the voltage exceeds the breakdown value to the range of 20 to 40 μm, as can be seen by following curve 42. This reduction in gap length at breakdown eliminates or minimizes disruptive image breakup.

The curves of FIG. 4 are plotted for a semiconductive layer 33 six mils thick. A layer 1 mil thick gives a marginal reduction in image breakup, and below that thickness very little effect is observed.

TABLE 1

| LAYER | Thickness | Resistivity | Dielectric Constant |
|---|---|---|---|
| Resistive Layer 33 | $L_1$ | $R_1$ | $E_1$ |
| Photo-Conductive Layer 34 | $L_2$ | | $E_2$ |
| Air Gap 37 | $L_3$ (variable) | | $E_3$ |
| Dielectric Receptor Layer 35 | $L_4$ | | $E_4$ |

The teachings of this invention are useful in situations where it is desirable to transfer a latent electrostatic charge image to any dielectric member, for example, an intermediate dielectric member which is subsequently toned and the image produced by toning is then transferred to a plain paper copy or a dielectric sheet which is itself toned to produce a copy.

While various aspects of the invention have been set forth by the drawings and the specification, it is to be understood that the foregoing detailed description is for illustration only and that various changes in parts, as well as the substitution of equivalent constituents for those shown and described, may be made without departing from the spirit and scope of the invention as set forth in the appended claims.

The foregoing functional explanation of the role of the semiconductor layer in reducing TESI image breakup is presented for explanatory purposes only, and does not limit the scope of the invention.

I claim:

1. An electrophotographic method comprising the steps of uniformly charging a photoconductive surface layer of a photoreceptor assembly, which photoreceptor assembly comprises the photoconductive surface layer, a conducting substrate, and a semiconductor layer having a thickness of at least 1 mil and a resistivity between $10^3$ and $10^{12}$ ohm centimeters, interposed between said photoconductive surface layer and said conducting substrate;

exposing the uniformly charged photoconductive surface layer to a pattern of light and shadow representing an original to be reproduced, whereby the surface layer is selectively discharged and a latent electrostatic image is produced thereon;

moving the image bearing portion of said photoconductive surface layer into proximity with a dielectric member; and transferring the latent electrostatic image to said dielectric member by means of the ionization of air in a gap between said photoreceptor assembly and said dielectric member.

2. A method in accordance with claim 1 further comprising the step of toning the latent electrostatic image on said dielectric member.

3. A method in accordance with claim 1 wherein the step of transferring the latent electrostatic image comprises transferring said image to a dielectric sheet.

4. A method in accordance with claim 1 wherein the step of transferring the latent electrostatic image comprises transferring said image to an intermediate dielectric member.

5. A method in accordance with claim 1 further comprising the steps of toning the latent electrostatic image on said intermediate dielectric member, and transferring the toned latent electrostatic image to a plain paper copy.

* * * * *